US007628405B2

(12) United States Patent
Smith, II

(10) Patent No.: US 7,628,405 B2
(45) Date of Patent: Dec. 8, 2009

(54) SKATE WITH AN ACCESSIBLE RUNNER SECURING SYSTEM AND METHODS THEREOF

(75) Inventor: George T. Smith, II, Canton, NY (US)

(73) Assignee: Crow Blade LLC, Ogdensburg, NY (US)

( * ) Notice: Subject to any disclaimer, the term of this patent is extended or adjusted under 35 U.S.C. 154(b) by 0 days.

(21) Appl. No.: 11/867,991

(22) Filed: Oct. 5, 2007

(65) Prior Publication Data

US 2008/0191431 A1 Aug. 14, 2008

Related U.S. Application Data

(62) Division of application No. 11/016,416, filed on Dec. 17, 2004.

(60) Provisional application No. 60/541,293, filed on Feb. 3, 2004.

(51) Int. Cl.

| | |
|---|---|
| ***A63C 1/30*** | (2006.01) |
| ***A63C 1/00*** | (2006.01) |
| ***A63C 3/00*** | (2006.01) |
| ***B62B 9/04*** | (2006.01) |
| ***B62B 13/00*** | (2006.01) |
| ***B62B 17/00*** | (2006.01) |

(52) U.S. Cl. ..... 280/11.18; 280/11.12; 280/11.35; 280/11.17; 280/28

(58) Field of Classification Search ..... 280/11.12, 280/11.18, 11.35, 11.17, 28
See application file for complete search history.

(56) References Cited

U.S. PATENT DOCUMENTS

| | | | | |
|---|---|---|---|---|
| 2,874,970 | A * | 2/1959 | Mall | 280/7.13 |
| 3,212,786 | A | 10/1965 | Florjancic et al. | |
| 4,074,909 | A | 2/1978 | Baikie | |
| D250,490 | S | 12/1978 | Baikie et al. | |
| D268,125 | S | 3/1983 | Baikie | |
| D271,036 | S | 10/1983 | Baikie | |
| 4,549,742 | A | 10/1985 | Husak et al. | |
| D325,416 | S | 4/1992 | Olson et al. | |
| 5,641,169 | A | 6/1997 | Bekessy | |

(Continued)

FOREIGN PATENT DOCUMENTS

| | | |
|---|---|---|
| CA | 1325819 | 1/1994 |

(Continued)

OTHER PUBLICATIONS

"Rebellion Hockey," Merchandise Catalogue, pp. 1-12.

(Continued)

*Primary Examiner*—S. Joseph Morano
*Assistant Examiner*—John R Olszewski
(74) *Attorney, Agent, or Firm*—Nixon Peabody LLP

(57) ABSTRACT

A blade for a skate includes a holder, a runner, and an attachment device. The holder includes a front section and a rear section where at least one of the front section and the rear section includes at least two, separate hollow regions and an aperture. The aperture extends through the holder between the at least two, separate hollow regions. The attachment device extends through a substantially solid portion of the holder between the two, separate hollow regions into the aperture and secures the runner to the holder. At least a portion of the attachment device used to secure the runner to the holder is accessible in the aperture.

14 Claims, 7 Drawing Sheets

U.S. PATENT DOCUMENTS

| | | | | |
|---|---|---|---|---|
| D414,017 | S | 9/1999 | Lefebvre et al. | |
| D430,251 | S | 8/2000 | Graf | |
| 6,164,667 | A | 12/2000 | Olivieri | |
| 6,295,679 | B1 | 10/2001 | Chenevert | |
| 6,419,241 | B1 | 7/2002 | Chenevert | |
| 6,485,033 | B2 * | 11/2002 | Nicoletti et al. | 280/11.18 |
| D475,205 | S | 6/2003 | Racine | |
| D488,845 | S | 4/2004 | Labonte et al. | |

FOREIGN PATENT DOCUMENTS

| | | |
|---|---|---|
| CA | 2145520 | 3/2006 |
| DE | 4127294 | 11/1992 |

OTHER PUBLICATIONS

Illustration Of An Ice Skate Blade Holder An Ice Skate Blade Sold Under The Trademark "TBLADE".
Illustration Of An Easton Skate "Z-AIR", Hockey 2002.
Illustration Of A "CCM E-Blade", ccmsports.com.
Illustration Of A CCM Skate "EXTERNO Prolite 3", ccmsports.com.
Illustration Of KOHO 3380 Blade Holder, and from p. 2000 KOHO Catalogue.

* cited by examiner

SKATE WITH AN ACCESSIBLE RUNNER SECURING SYSTEM AND METHODS THEREOF

This is a divisional application of U.S. patent application Ser. No. 11/016,416, filed on Dec. 17, 2004, which claims the benefit of U.S. Provisional Patent Application Ser. No. 60/541,293 filed Feb. 3, 2004 and which are hereby incorporated by reference in their entirety.

FIELD OF THE INVENTION

The present invention generally relates to ice skates and, more particularly, to a skate with an accessible runner securing system.

BACKGROUND OF THE INVENTION

A variety of different techniques have been used to secure a runner to a holder. For example, with one prior technique an upper portion of the runner is seated in a longitudinal groove in the base of the holder. A plurality of threaded openings are formed to extend horizontally through the upper portion of the runner and a base portion of the holder. A screw is secured in each of the horizontal openings to attach the runner to the holder. With these horizontally extending screws, the runner can be attached or removed from the skate holder by screwing or unscrewing the screws from the openings. Unfortunately, pressure on the runner from use of the skate can cause one or more of the screws to loosen which can loosen the connection of the runner to the holder and degrade skating performance.

With another prior technique, an upper portion of the runner is again seated in a longitudinal groove in the base of the holder. Threaded posts are secured to an upper portion of the runner and extend up into the front and rear cup portions of the holder. A nut is secured on the end of each of these threaded posts to secure the runner to the holder. With these threaded posts, the runner is more securely fastened to the holder. Unfortunately, the holder is attached to the boot in a manner which prevents access to the nut used to secured the runner to the holder in the front and rear cups. As a result, once the runner is attached, the runner cannot be replaced, except by removing the holder from the boot or by cutting a hole through the sole of the boot.

Another problem with these prior designs is with the durability and weight of the ice skate. To make these prior designs more durable, typically the holder is a manufactured as solid, one piece unit. Unfortunately, this solid design for the holder adds to the overall weight of the skate.

SUMMARY OF THE INVENTION

A blade for a skate in accordance with the embodiments of the present invention includes a holder, a runner, and an attachment device. The holder includes a front section and a rear section where at least one of the front section and the rear section includes at least two, separate hollow regions and an aperture. The aperture extends through the holder between the at least two, separate hollow regions. The attachment device extends through a substantially solid portion of the holder between the two, separate hollow regions into the aperture and secures the runner to the holder. At least a portion of the attachment device used to secure the runner to the holder is accessible in the aperture.

A method for securing a runner to a holder in accordance with the embodiments of the present invention includes providing a holder comprising a front section and a rear section where at least one of the front section and the rear section comprises at least two, separate hollow regions and an aperture. The aperture extends through the holder between the at least two, separate hollow regions. An edge of a runner is positioned against a portion of the holder. An attachment device is extended through a substantially solid portion of the holder between the at least two, separate hollow regions into the aperture and secures the runner to the holder. At least a portion of the attachment device used to secure the runner to the holder is accessible in the aperture.

A skate in accordance with the embodiments of the present invention includes a boot, a holder, a runner, and an attachment device. The holder is secured to a base of the boot and includes a front section and a rear section where at least one of the front section and the rear section includes at least two, separate hollow regions and an aperture. The aperture extends through the holder between the at least two, separate hollow regions. The attachment device extends through a substantially solid portion of the holder between the at least two, separate hollow regions into the aperture and secures the runner to the holder. At least a portion of the attachment device used to secure the runner to the holder is accessible in the aperture.

A method for securing a runner to a skate in accordance with the embodiments of the present invention includes providing a holder with a front section and a rear section where at least one of the front section and the rear section comprises at least two, separate hollow regions and an aperture. The aperture extends through the holder between the at least two, separate hollow regions, the holder is secured to a boot. An edge of a runner is positioned against a portion of the holder. An attachment device is extended through a substantially solid portion of the holder between the at least two, separate hollow regions into the aperture. The attachment device secures the runner to the holder. At least a portion of the attachment device used to secure the runner to the holder is accessible in the aperture.

The present invention provides a lightweight and strong holder from which a runner easily can be attached to or removed from. As a result, the runner can easily be switched to a runner that is appropriate for the particular ice conditions and/or for the particular type of skating to be performed, e.g. speed skating, figure skating, hockey, or recreational. Additionally, the ice skate is more comfortable to use and is more durable.

DETAILED DESCRIPTION

A skate 10 in accordance with embodiments of the present invention is illustrated in FIGS. 1-4. The skate 10 includes a boot 12, a skate holder 14(1), and a runner 16(1), although the skate 10 can comprise other numbers and types of components in other configurations. The present invention provides an ice skate 10 in which the runner 16(1) of the ice skate can be easily attached to or removed from a skate holder 14(1).

Referring to FIGS. 1-4, the boot 12 includes a shell 18 shaped to receive a foot and a sole 20 connected to the shell 18, although the boot 12 can comprise other numbers and types of components in other configurations. By way of example, a boot and method for making a boot for a skate are described in U.S. Pat. No. 6,295,679, which is herein incorporated by reference. Since boots for skates are well known to those of ordinary skill in the art, they will not be described in further detail here.

Figure 1:
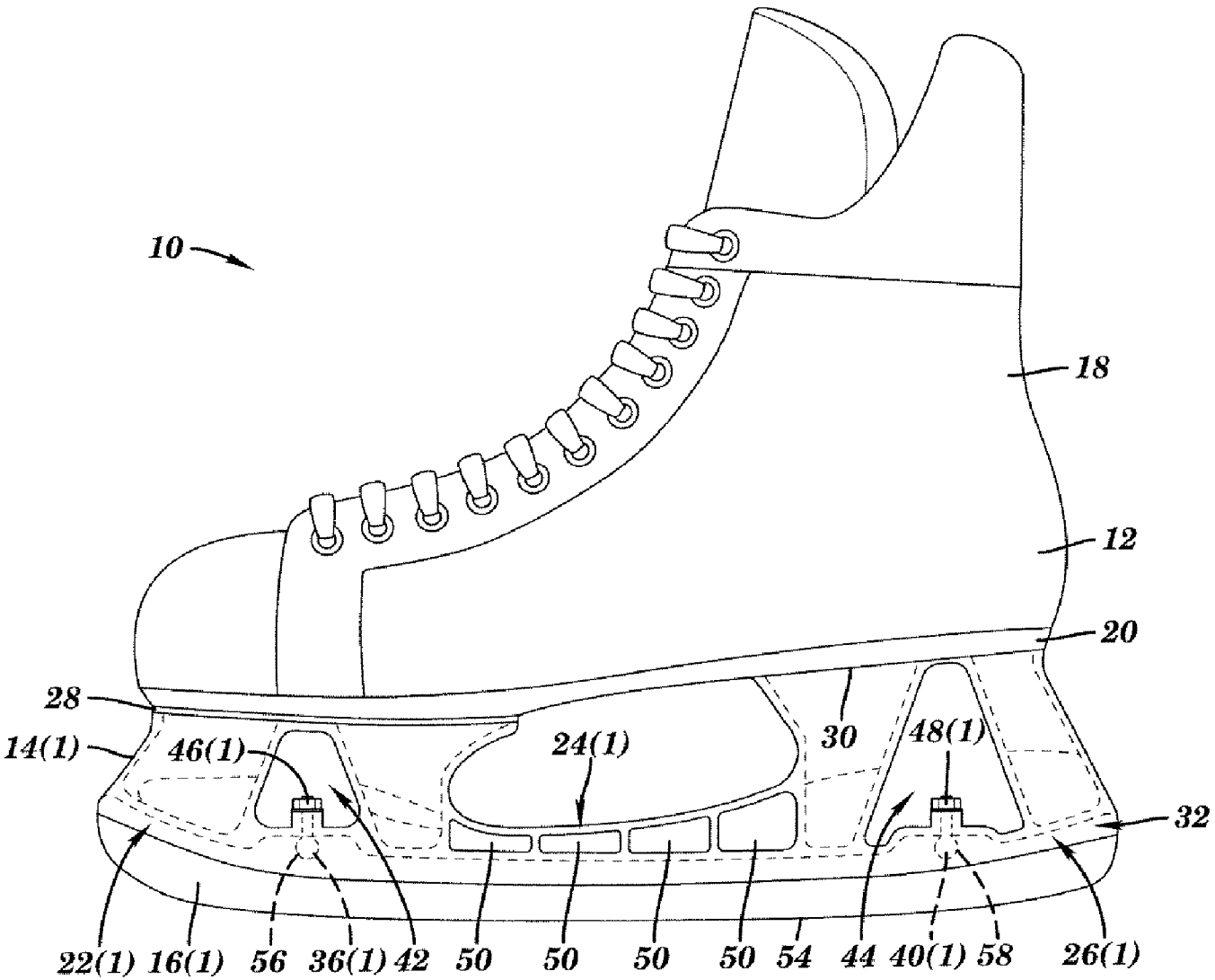
FIG. 1 is a side view of a skate with an accessible runner securing system in accordance with embodiments of the present invention.
Figure 2:
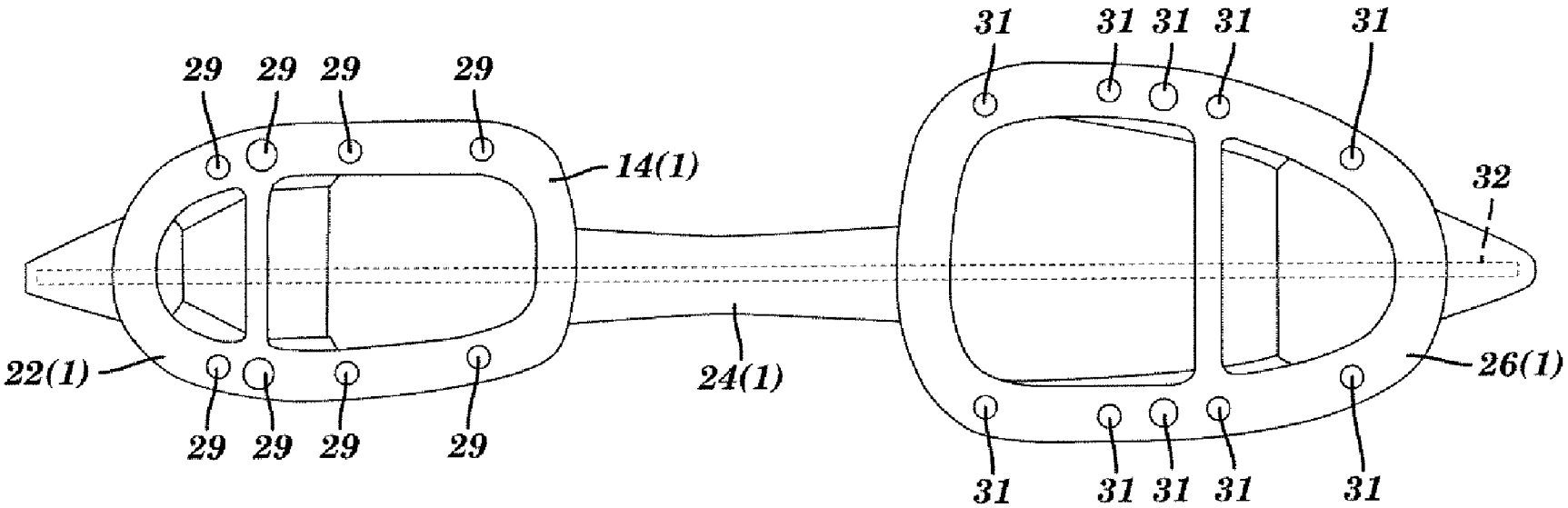
FIG. 2 is a top view of the skate shown in FIG. 1.
Figure 3:
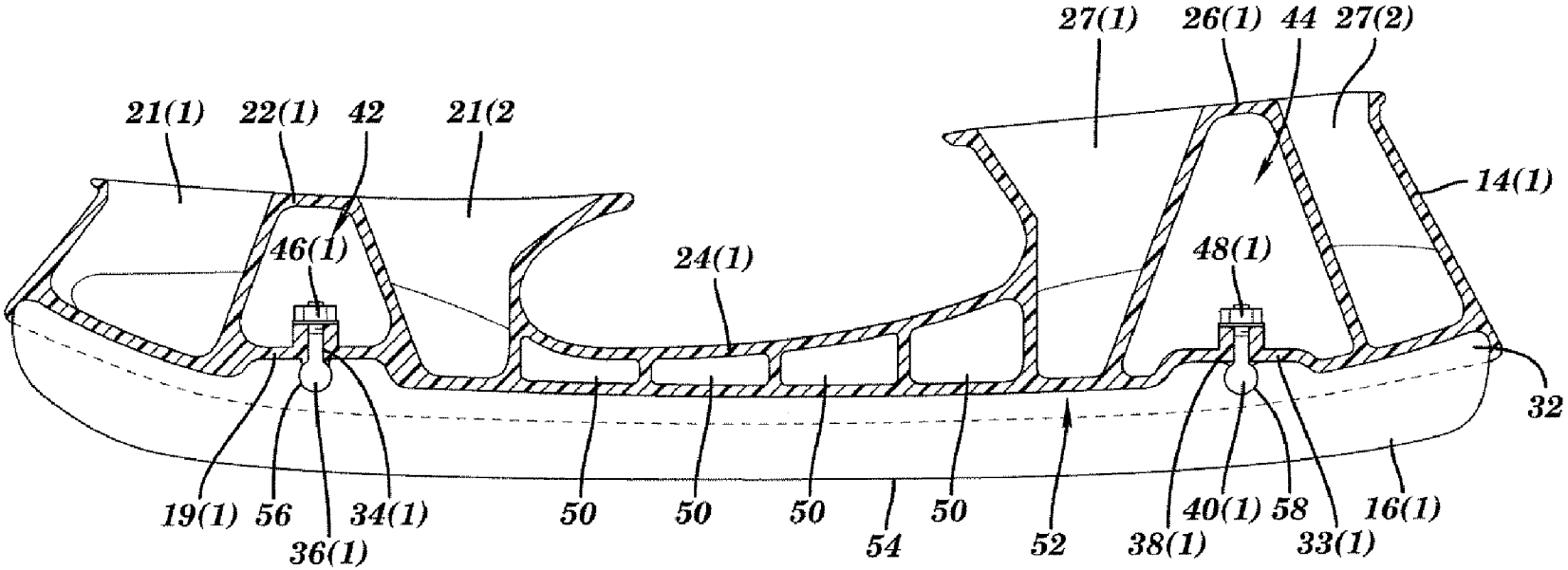
FIG. 3 is a side, cross-sectional view of the skate shown in FIG. 1.
Figure 4:
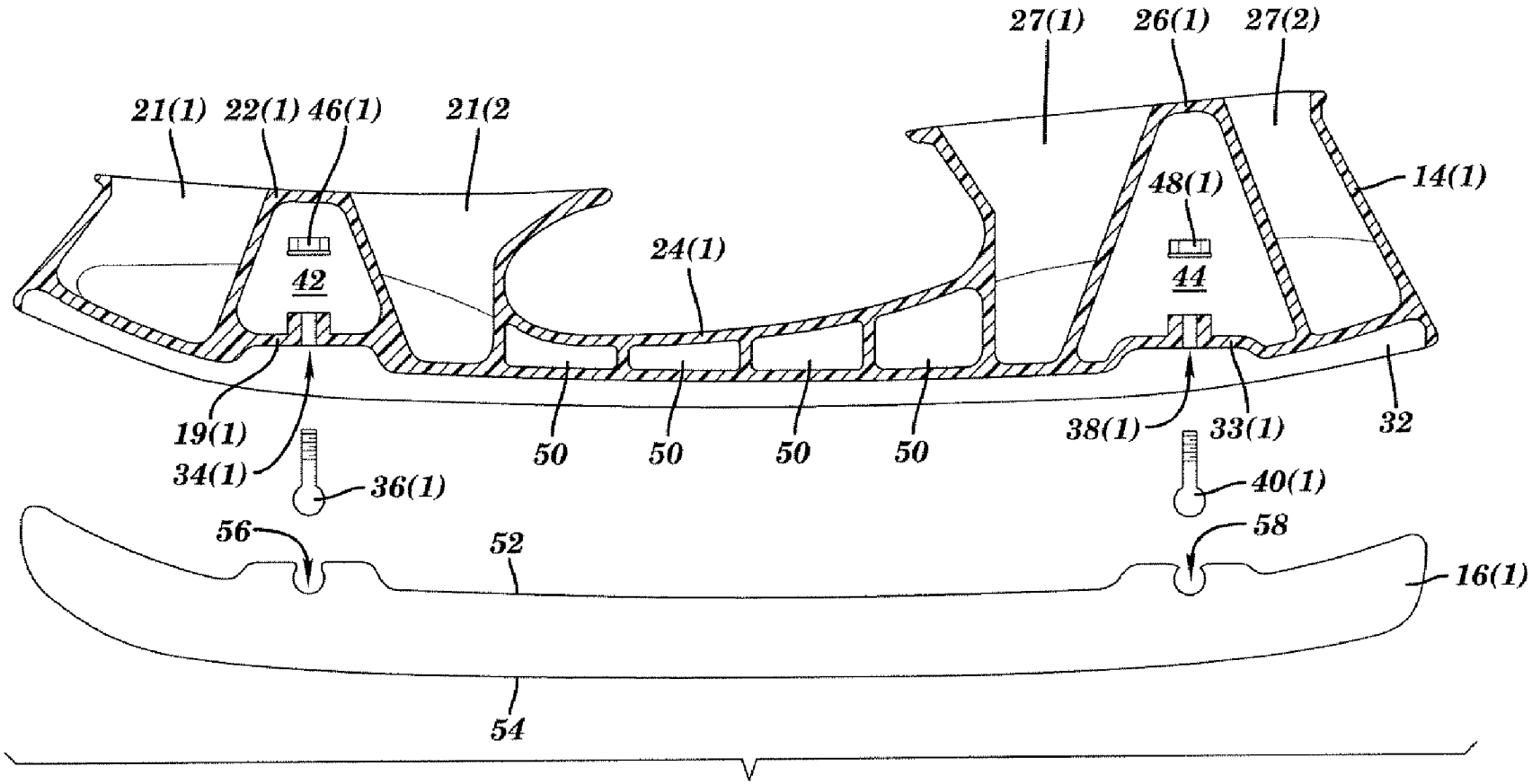
FIG. 4 is an exploded, view of the skate shown in FIG. 1.
Figure 5:
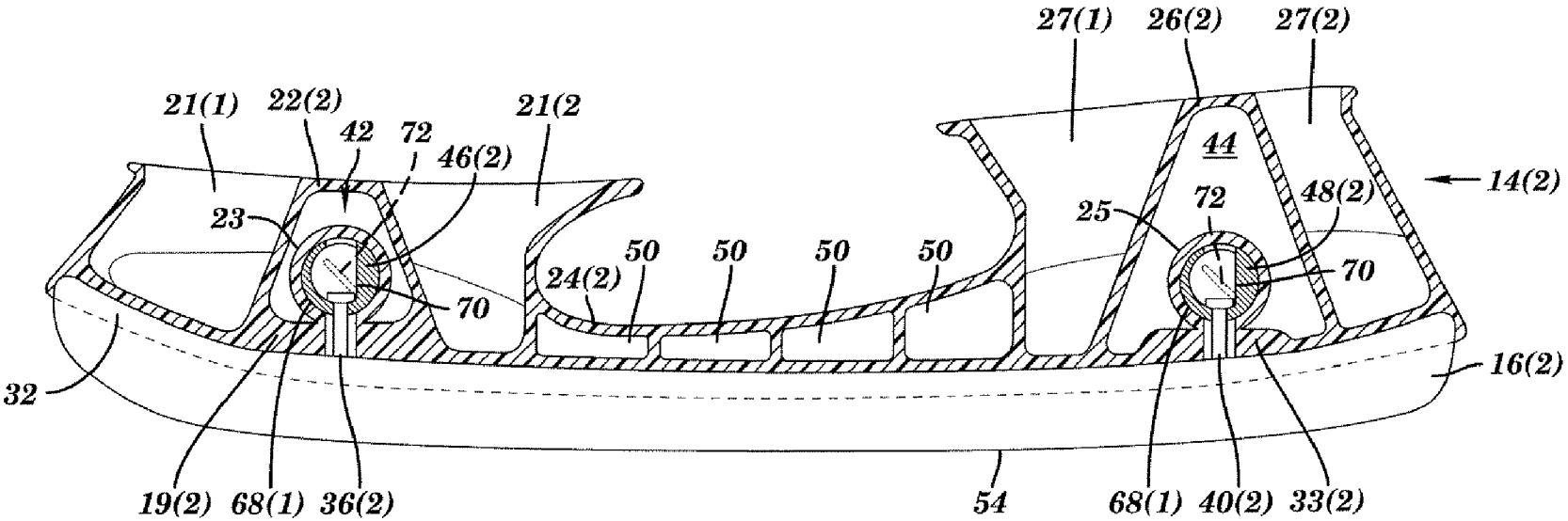
FIG. 5 is a side, cross-sectional view of a skate with an accessible runner securing system in accordance with embodiments of the present invention.
Figure 6:
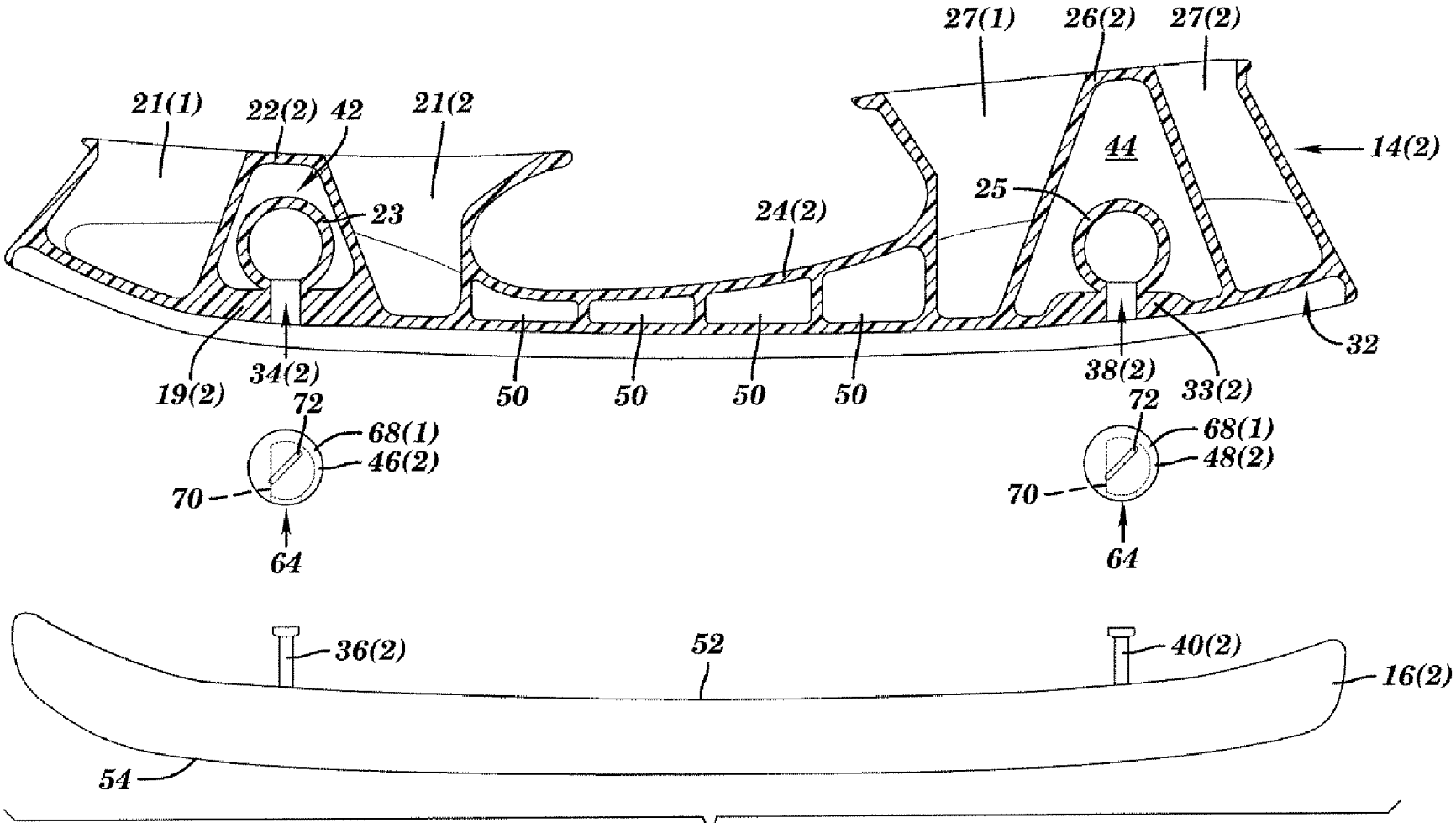
FIG. 6 is an exploded, view of the skate shown in FIG. 5.

The holder 14(1) includes a front section 22(1), a bridge section 24(1), and a rear section 26(1), although the holder can comprise other numbers and types of components in other configurations and other types of holders can be used, such as 14(2) shown in FIGS. 5-6. Referring back to FIGS. 1-4, the bridge section 24(1) couples the front and rear sections 22(1) and 26(1) together and in this embodiment the front, bridge, and rear sections 22(1), 24(1), and 26(1) are integrally formed, although other configurations could be used. An upper portion 28 of the front section 22(1) is secured to a front portion of the sole 20 with rivets through openings 29 in portion 28 and an upper portion 30 of the rear section 26(1) is secured to a rear portion of the sole 20 with rivets through openings 31 in portion 30, although other attachment configurations and other devices to secure the holder 14(1) to the sole 20 can be used. A longitudinally extending groove 32 is formed along a lower portion of the front, bridge and rear sections 22(1), 24(1), and 26(1) of the holder 14(1) and is shaped to receive an upper portion of the runner 16(1).

The front section 22(1) a pair of separated, hollow regions 21(1)-21(2) and an opening 42 positioned between the hollow regions 21(1)-21(2), although other configurations could be used, such as multiple hollow regions or openings or having an opening which only extends partially through the holder 14(1). Similarly, the rear section 26(1) includes pair of separated, hollow regions 27(1)-27(2) and an opening 44 positioned between the hollow regions 27(1)-27(2), although other configurations could be used, such as multiple hollow regions or openings or having an opening which only extends partially through the holder 14(1). The hollow regions 21(1), 21(2), 27(1), and 27(2) in the holder 14(1) help to reduce the weight of the skate without negatively effecting the structural integrity and strength of the holder 14(1). As a result, with this skate holder 14(1) the skate 10 is noticeably lighter while still being durable.

The openings 42 and 44 in the front and rear sections 22(1) and 26(1) provide access to nuts 46(1) and 48(1) which are used to secure the runner 16(1) to the holder 14(1) so that an individual can easily attach or remove and replace a runner 16(1) on a skate 10. The openings 42 and 44 are sized so that an individual can easily access the access the nuts 46(1) and 48(1) secured on the threaded attachment devices 36(1) and 40(1) with the individual's fingers or a tool. Accordingly, with the present invention, an individual wearing the skate 10 can easily secure or remove a runner 16(1) from holder 14(1), without having to remove the holder 14(1) from the boot 12 and without having to use the prior horizontal technique for securing a runner to a holder.

The front section 22(1) has a passage 34(1) that extends through a wall 19(1) of the holder 14(1) which is positioned between the hollow regions 21(1)-21(2) and which is sized to receive one end of a threaded attachment device 36(1), such as a bolt. The rear section 26(1) has a passage 38(1) that extends through a wall 33(1) of the holder 14(1) between the hollow regions 27(1)-27(2) and which is sized to receive one end of another threaded attachment device 40(1). The passages 34(1) and 38(1) extend in a substantially vertical direction, although other directions and configurations for the passages 34(1) and 38(1) can be used, such as having the passages extend at an angle.

With this configuration for the attachment devices 36(1) and 40(1) through the passages 34(1) and 38(1), the runner 16(1) is pulled up into the holder 14(1) so that pressure on the edges of the runner 16(1) during skating will not loosen the connection of the runner 16(1) to the holder 14(1). Additionally, with this configuration the strength of the holder 14(1) is maintained because attachment devices 36(1) and 40(1) extend through the walls 19(1) and 33(1) and not into and/or through any of the hollow regions 21(1), 21(2), 27(1), or 27(2). As a result, the strength of the hollow regions 21(1), 21(2), 27(1), or 27(2) and thus of the holder 14(1) is not compromised by the attachment of the runner 16(1) to the holder 14(1).

The holder 14(1) also includes the bridge section 24(1) which has a plurality of openings 50 extend. The openings 50 in the bridge section 24(1) also help to reduce the overall weight of the skate 10.

The runner 16(1) includes an upper, elongated edge 52 which is dimensioned to fit within the groove 32 in the front, bridge, and rear sections 22(1), 24(1), and 26(1) of the holder 14(1) and a lower, elongated edge 54 which forms the skating edge for the skate 10. A pair of cavities 56 and 58 are formed in the upper elongated edge 52, although other numbers and types of mechanisms for securing one end of the attachment devices 36(1) and 40(1) to the runner 16(1) could be used, such as integrally forming the attachment devices with the runner 16(1). The cavity 56 is shaped to mate with one end of the threaded attachment device 36(1) and the cavity 58 is shaped to mate with one end of the threaded attachment device 40(1). Although one type of runner 16(1)is shown, other types of runners can be used.

The threaded attachment devices 36(1) and 40(1) extend out away from the edge 52 of the runner 16(1). The threaded attachment device 36(1) has another threaded end that extends up through the passage 34(1) in the front section 22(1) to the opening 42. The threaded attachment device 40(1) has another threaded end that extends up through the passage 38(1) in the rear section 26(1) to the opening 44. A threaded nut 46(1) is rotationally seated on the thread end of the attachment device 36(1) and another nut 48(1) is seated on the threaded end of the attachment device 40(1). The nuts 46(1) and 48(1) are rotated on the threaded attachment devices 36(1) and 40(1) to secure the runner 16(1) to the holder 14(1) or to release the threaded attachment devices 36(1) and 40(1) so the runner 16(1) can be replaced.

A method for securing a runner 16(1) to the holder 14(1) will now be described with reference to FIGS. 1-4. One end of threaded attachment device is mated with the cavity 56 and one end of threaded attachment device 40(1) is mated with the cavity 58. Next, the threaded attachment device 36(1) is passed through passage 34(1) and extends into the opening 42 in the front section 22(1) and threaded attachment device 40(1) is passed through passage 38(1) and extends into the opening 44 in the rear section 26(1). An upper edge 52 of the runner 16(1) is seated in the groove 32 in the front, bridge, and rear sections 22(1), 24(1), and 26(1) of the holder 14(1). A nut 46(1) is threaded on the threaded attachment device 36(1) and another nut 48(1) is threaded on the threaded attachment device 40(1), The nuts 46(1) and 48(1) are tightened on the threaded attachment devices 36(1) and 40(1) until the runner 16(1) is secure in the holder 14(1). To replace the runner 16(1), the nuts 46(1) and 48(1) are simply unscrewed from the threaded attachment devices 36(1) and 40(1) and the runner 16(1) is removed from the holder 14(1).

Figure 7:
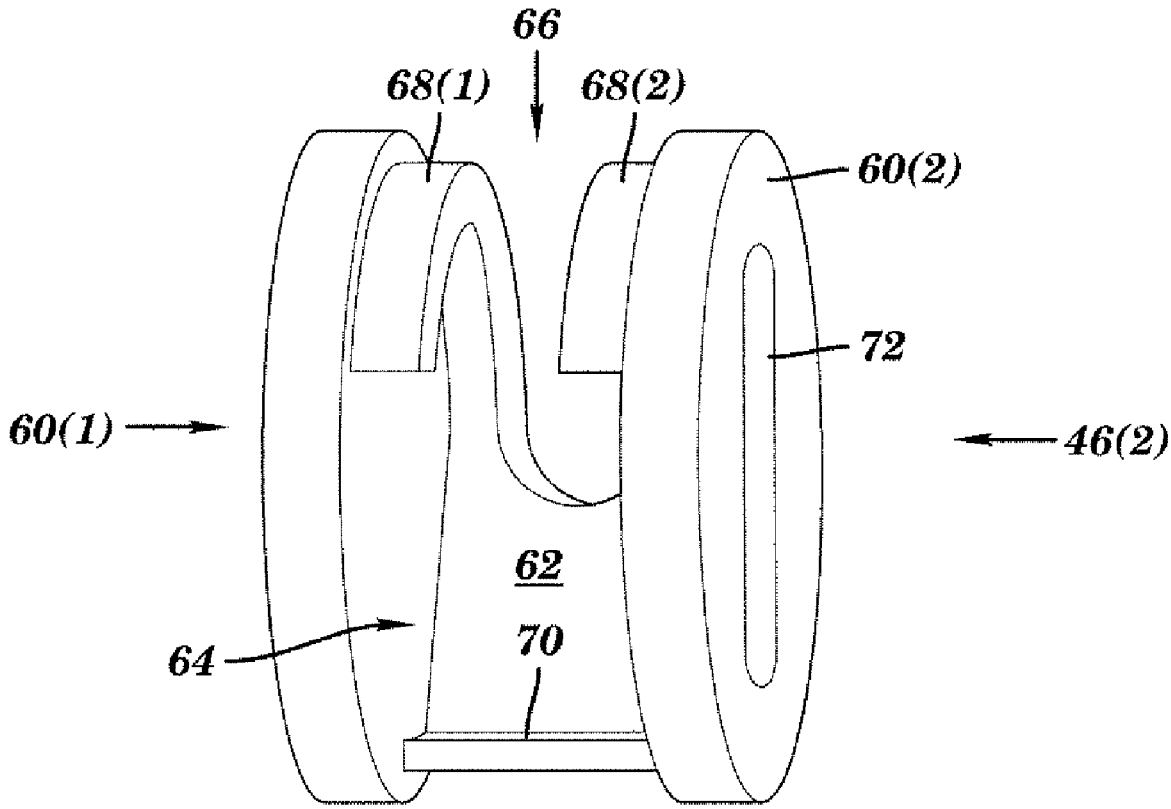
FIG. 7 is a perspective view of a lug used in the accessible runner securing system shown in FIG. 5.

Referring to FIGS. 5-7, an alternative embodiment for the holder 14(2) for the skate 10 is illustrated. Elements in the embodiment shown in FIGS. 5-7 which are like those in the embodiment shown in FIGS. 1-4 will have like reference numerals and will not be described again. For ease of illustration the boot 12 is not illustrated in this embodiment.

The holder 14(2) is the same as the holder 14(1), except as described and illustrated herein. The holder 14(2) includes a front section 22(2), a bridge section 24(2), and a rear section 26(2) which couples the front and rear sections 22(2) and 26(2) together, although the holder can comprise other numbers and types of components in other configurations. The front section 22(2) includes a passage 34(2) that extends through a wall 19(2) of the holder 14(2) which is positioned between the hollow regions 21(1)-21(2) and which is sized to receive one end of an attachment device 36(2), such as a nail head. Similarly, the rear section 26(2) includes a passage 38(2) that extends through a wall 33(2) of the holder 14(2) which is positioned between the hollow regions 27(1)-27(2) and which is sized to receive one end of another attachment device 40(2), such as a nail head. The passages 34(2) and 38(2) extend in a substantially vertical direction, although other configurations for the passages 34(2) and 38(2) can be used.

With the vertical configuration for the attachment devices 36(2) and 40(2) through the passages 34(2) and 38(2), pressure on the edges of the runner 16(2) will not loosen the connection of the runner 16(2) to the holder 14(2). Additionally, with this configuration the strength of the holder 14(2) is maintained because attachment devices 36(2) and 40(2) extend through the walls 19(2) and 33(2) and not into and/or through any of the hollow regions 21(1), 21(2), 27(1), or 27(2) of the holder 14(2). As a result, the strength of the hollow regions 21(1), 21(2), 27(1), or 27(2) and thus of the holder 14(2) is not compromised by the attachment of the runner 16(2) to the holder 14(2).

The front section 22(2) also includes a lug nut housing 23 positioned in the opening 42 for the lug nut 46(2) and the rear section 26(2) includes a lug nut housing 25 positioned in the opening 44 for the lug nut 46(2). The lug nut housing 23 has an opening to the passage 34(2) which is sized to receive the attachment device 36(2) and the lug nut housing 25 has an opening which is sized to receive the attachment device 40(2).

The runner 16(2) is the same as the runner 16(1), except as described and illustrated herein. A pair of attachment devices 36(2) and 40(2) are secured to the upper edge 52 of the runner 16(2) with welds, although other manners for securing the attachment devices 36(2) and 40(2) to the runner 16(2) could be used.

The lug nuts 46(2) and 48(2) each include a pair of outer rims 60(1) and 60(2) which are joined by a center section 62, although lug nuts 46(2) and 48(2) may each comprise other sections in other configurations. Since lug nut 48(2) is the same as lug nut 46(2), only lug nut 46(2) is described herein and shown in FIG. 7. The center section 62 of each of the lug nuts 46(2) and 48(2) includes a passage 64 which is sized to fit over the nail head end of attachment devices 36(2) and 40(2). A channel 66 is formed in the center section 62 of each of the lug nuts 46(2) and 48(2) and extends partially around the center section. The edges 68(1) and 68(2) of the center section 62 about the channel 66 in each of the lug nuts 46(2) and 48(2) are tapered and gradually increase in thickness towards the end of the channel 66. The end of the center section 62 after the end of the channel 66 in each of the lug nuts 46(2) and 48(2) has a substantially flat portion 70. Each of the lug nuts 46(2) and 48(2) includes a slot 72 to receive the head of a flat head screw driver or other tool to rotate the lug nuts 46(2) and 48(2), although other numbers and configurations for the slot as well as other manners for rotating the lug nuts 46(2) and 48(2) can be used.

The lug nut 46(2) is designed to mate with one end of the attachment device 36(2) through the opening 64 and the lug nut 48(2) is designed to mate with one end of the attachment device 40(2) through the opening 64. If the lug nut 46(2) is rotated, the head of the attachment device 36(2) is sized to rest and ride on the edges 68(1) and 68(2) of center section 62 of lug nut 46(2). Similarly, if the lug nut 48(2) is rotated, the head of the attachment device 40(2) is sized to rest and ride on the edges 68(1) and 68(2) of center section 62 of lug nut 48(2). Although two attachment devices 36(2) and 40(2) are shown with lug nuts 46(2) and 48(2), other numbers and types of attachment devices and lug nuts can be used.

A method for securing a runner 16(2) to the holder 14(2) shown in FIGS. 5-6 is the same as the method for securing the runner 16(2) to the holder 14(1) shown in FIGS. 1-4 except as described below. One end of the attachment device 36(2) is passed through passage 34(2) and through the opening 64 in the lug nut 46(2) into the lug nut housing 23 in opening 42 in the front section 22(1). One end of the attachment device 40(2) is passed through passage 38(2) and through the opening 64 in the lug nut 48(2) into the lug nut housing 23 in opening 44 in the rear section 26(1). An upper edge 52 of the runner 16(2) is seated in the groove 32 in the front, bridge, and rear sections 22(2), 24(2), and 26(2) of the holder 14(2). A flat head screw driver or other tool is seated in the slot 72 of the lug nut 46(2) and is rotated. Rotating the lug nut 46(2) seats the head of the attachment device 36(2) on the edges 68(1) and 68(2) of the lug nut 46(2). Continued rotation of the lug nut 46(2) causes the head of the attachment device 36(2) to ride up the edges 68(1) and 68(2) which pulls the runner 16(2) further up into the slot 32 to secure one end of the runner 16(2) against the holder 14(2). Similarly, a flat head screw driver or other tool is seated in the slot 72 of the lug nut 48(2) and is rotated. Rotating the lug nut 48(2) seats the head of the attachment device 40(2) on the edges 68(1) and 68(2) of the lug nut 48(2). Continued rotation of the lug nut 48(2) causes the head of the attachment device 40(2) to ride up the edges 68(1) and 68(2) which pulls the runner 16(2) further up into the slot 32 to secure another end of the runner 16(2) against the holder 14(2). To replace the runner 16(2), the process described above is just reversed.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A skate comprising:

a boot;

a holder secured to a base of the boot, the holder comprising a front section and a rear section, wherein at least one of the front section and the rear section comprises at least two, separate hollow regions and an aperture which extends through the holder between the at least two, separate hollow regions and separates the at least two separate hollow regions from each other along a length of the holder;

a runner; and an attachment device that extends through a substantially solid portion of the holder between the at least two, separate hollow regions into the aperture, wherein the attachment device secures the runner to the holder and wherein at least a portion of the attachment device used to secure the runner to the holder is accessible in the aperture.

2. The skate as set forth in claim 1 wherein the attachment device comprises a threaded bolt and a threaded nut, the threaded bolt is attached at one end to the runner and the threaded nut is rotationally seated on the threaded bolt to secure the runner to the holder wherein the threaded nut is accessible in the aperture.

3. The skate as set forth in claim 1 wherein the attachment device comprises a shaft with a head portion and a lug nut, the shaft is attached at one end to the runner and the lug nut is rotationally seated on the head portion of the shaft to secure the runner to the holder, wherein the lug nut is accessible in the aperture.

4. The skate as set forth in claim 1 wherein the other of the one of the front section and the rear section comprises at least two, other separate hollow regions and another aperture which extends through the holder between the at least two, other separate hollow regions and further comprising another attachment device that extends through another substantially solid portion of the holder between the at least two other separate hollow regions into the other aperture and wherein the other attachment device secures the runner to the holder and wherein at least a portion of the other attachment device used to secure the runner to the holder is accessible in the aperture.

5. The skate as set forth in claim 4 further comprising a bridge section between the front section and the rear section.

6. The skate as set forth in claim 5 further comprising a plurality of openings in a bridge section.

7. The skate as set forth in claim 1 wherein the at least two, separate hollow regions are enclosed.

8. A method for securing a runner to a skate, the method comprising:

providing a holder comprising a front section and a rear section, wherein at least one of the front section and the rear section comprises at least two, separate hollow regions and an aperture which extends through the holder between the at least two, separate hollow regions, the holder is secured to a boot and separates the at least two separate hollow regions from each other along a length of the holder;

positioning an edge of a runner against a portion of the holder; and extending an attachment device through a substantially solid portion of the holder between the at least two, separate hollow regions into the aperture, wherein the attachment device secures the runner to the holder and wherein at least a portion of the attachment device used to secure the runner to the holder is accessible in the aperture.

9. The method as set forth in claim 8 wherein the attachment device comprises a threaded bolt and a threaded nut, the threaded bolt is attached at one end to the runner and the threaded nut is rotationally seated on the threaded bolt to secure the runner to the holder wherein the threaded nut is accessible in the aperture.

10. The method as set forth in claim 8 wherein the attachment device comprises a shaft with a head portion and a lug nut, the shaft is attached at one end to the runner and the lug nut is rotationally seated on the head portion of the shaft to secure the runner to the holder, wherein the lug nut is accessible in the aperture.

11. the method as set forth in claim 8 wherein the other of the one of the front section and the rear section comprises at least two, other separate hollow regions and another aperture which extends through the holder between the at least two, other separate hollow regions and further comprising another attachment device that extends through another substantially solid portion of the holder between the at least two other separate hollow regions into the other aperture and wherein the other attachment device secures the runner to the holder and wherein at least a portion of the other attachment device used to secure the runner to the holder is accessible in the aperture.

12. The method as set forth in claim 11 farther comprising providing a bridge section between the front section and the rear section.

13. The method as set forth in claim 12 farther comprising a plurality of openings in a bridge section.

14. The method as set forth in claim 8 wherein the at least two, separate hollow regions are enclosed.

* * * * *